United States Patent [19]

Bonnet et al.

[11] 4,311,156

[45] Jan. 19, 1982

[54] METHOD FOR AROMATIZING TOBACCO SMOKE

[75] Inventors: Jaques Bonnet, Lausanne; Jean-Pierre Lebet, Montreux, both of Switzerland

[73] Assignee: Baumgartner Papier S.A., Switzerland

[21] Appl. No.: 159,623

[22] Filed: Jun. 16, 1980

[30] Foreign Application Priority Data

Jun. 14, 1979 [CH] Switzerland ..... 5551/79

[51] Int. Cl.[3] ..... A24D 3/00; A24D 3/14

[52] U.S. Cl. ..... 131/274; 131/275; 131/276; 131/335

[58] Field of Search ..... 131/144, 9, 10 R, 10.5, 131/10.7, 10.9, 17 R, 10.3, 261 R, 261 A, 331, 332, 334, 335, 275, 276

[56] References Cited

U.S. PATENT DOCUMENTS

| | | | |
|---|---|---|---|
| 1,972,718 | 9/1934 | Sharlit | 131/17 R |
| 3,972,335 | 8/1976 | Tiggelbeck | 131/267 |

FOREIGN PATENT DOCUMENTS

| | | | |
|---|---|---|---|
| 1448989 | 7/1966 | France | 131/261 A |
| 1570621 | 6/1969 | France | 131/261 R |

*Primary Examiner*—V. Millin

*Attorney, Agent, or Firm*—Eric P. Schellin

[57] ABSTRACT

A highly porous magnesium silicate hydrate charged with menthol is used in the mouthpiece of the cigarette in order to aromatise the smoke drawn from a cigarette in a simple manner with menthol or a natural or synthetic tobacco extract.

6 Claims, No Drawings

METHOD FOR AROMATIZING TOBACCO SMOKE

BACKGROUND OF THE INVENTION

The invention relates to a method for aromatising tobacco smoke drawn from a cigarette, a cigarette end-piece, in particular a cigarette filter for carrying out this method, and a use for the method.

In producing mentholated cigarettes, it is already known to spray for example the shredded tobacco, the cigarette packet or the acetate filter with a menthol solution during their manufacture. However, such methods have the drawback that the manufacture of mentholated cigarettes must be carried out isolated from the manufacture of other cigarettes because of the strong volatility of menthol on the one hand, and the strong affinity of tobacco for this latter, otherwise the other cigarettes will likewise have an additional taste. If the manufacture of mentholated cigarettes is done only in relatively small production quantities due to their limited demand, then the total production line has to be decontaminated after each changeover to nonmentholated cigarettes, and this is understandably extremely complicated and costly, because in addition to the cleaning costs, the production plant must remain shut down during the total cleaning time.

As an increasing number of lighter cigarettes, i.e. cigarettes with a low nicotine and tar content in the smoke are required, it could be advantageous to aromatise the smoke produced by such cigarettes for example by means of tobacco extract or synthetic tobacco aroma.

However the methods tried up to the present time all have the drawback that a relatively large amount of often very expensive aroma substance is necessary in order to obtain sufficient aromatising, and after a short time the aroma substance has evaporated and shows no further satisfactory action, so that such cigarettes can be stored only for an insufficient time.

The object of the present invention is to provide a method in which the aforesaid drawbacks are absent, i.e. which for example makes possible the manufacture of mentholated filter cigarettes without contaminating the production plant, requires relatively small quantities of aroma substances, is simple to use, and gives the thus aromatised cigarettes a long storability.

This object is attained in a method of the aforesaid type according to the invention, by using a porous magnesium silicate and/or magnesium silicate hydrate charged with aroma substances in the cigarette mouthpiece. It has been shown that granular porous magnesium silicate or magnesium silicate hydrate has an excellent adsorption capacity for storing aroma substances, and even when such aroma carriers charged with aroma substances are stored in open conditions for a time of several months, the evaporation of the stored aroma substance is so small that a sufficient quantity thereof is still present stored in the aroma carrier. On the other hand, when such an aroma carrier charged with aroma substances becomes located in a warm, moist smoke stream of a cigarette, a determined quantity of aroma substance is given up into the warm, moist smoke stream which flows past for each draw by the smoker on such a cigarette, as is desired.

It is advantageous if a synthetic tobacco aroma, a tobacco extract or menthol is used as the aroma substance.

It is advantageous to use a magnesium silicate or magnesium silicate hydrate with a magnesium content of at least 4 weight % and preferably 8 to 25 weight %, with respect to the dry matter.

It is further advantageous to use a magnesium silicate or magnesium silicate hydrate charged with 5 to 14 weight % and preferably 8 to 10 weight %, with respect to the uncharged magnesium silicate or hydrate. It is also advantageous if the magnesium silicate and/or magnesium silicate hydrate charged with aroma substances is worked into at least a part of the filter material intended for a cigarette filter, for example a double filter.

The present invention further relates to a cigarette end piece, in particular a cigarette end filter for carrying out the method according to the invention, characterised by comprising a chamber containing at least the magnesium silicate and/or magnesium silicate hydrate charged with aroma substances.

The present invention further relates to a use for the method according to the invention in mentholating tobacco smoke.

The advantages of the method according to the invention are described hereinafter with reference to the aromatising of smoke with menthol in comparison to other methods.

1ST COMPARISON EXAMPLE

Filter cigarettes of the same make and having the same moisture content were smoked under standard conditions, i.e. every minute a draw of 35 ml volume lasting 2 seconds, with the taste being monitored parallel thereto by test personnel, the chamber filters used therein being filled on the one hand with activated carbon prepared from coconut and charged with menthol, and on the other hand according to the invention with granular high-porous magnesium silicate hydrate charged with menthol.

The following results were obtained:

| Methol content with respect to the weight of the uncharged carrier material | Aromatising action with magnesium silicate hydrate as carrier material | Aromatising action with activated carbon prepared from coconut as carrier material |
|---|---|---|
| 5 weight % | Smoke slightly mentholated | Smoke unmentholated |
| 10 weight | smoke correctly mentholated | Smoke unmentholated |
| 20 weight % | Supersaturation of the magnesium silicate hydrate | Smoke unmentholated |
| 30 weight % | Supersaturation the magnesium silicate hydrate | Smoke slightly mentholated |
| 40 weight % | Supersaturation of the magnesium silicate hydrate | Smoke weakly mentholated |
| 50 weight % | Supersaturation of the magnesium silicate hydrate | Supersaturation of the activated carbon |

As can be seen, when using magnesium silicate hydrate as the carrier and storage material for the menthol, even with a small charging quantity of 10 weight % of menthol (with respect to the weight of the uncharged magnesium silicate hydrate), a satisfactory aromatising of the smoke can be attained. When using activated carbon as the carrier and storage material for the menthol, even charging quantities of 40 weight % of menthol are not sufficient to give satisfactory aromatising of the smoke. Moreover, as menthol is relatively expensive, it is a great advantage if a satisfactory aromatising of the smoke can be obtained with small menthol quantities. In comparison with filter cigarettes identical from the tobacco aspect, in which the chamber of the filter chamber was filled on the one hand with (a) magnesium silicate hydrate containing 10 weight % of menthol and on the other hand with (b) activated carbon containing 40 weight % of menthol, it was found that with the two different carrier materials, uniform quantities of menthol were given up during successive draws on the cigarette, into the warm, moist, passing smoke. However, in case (a), in comparison to case (b), about double the quantity of menthol was given up into the passing smoke, namely in 9 draws carried out under standard conditions, about 0.5 mg of menthol in the particulate phase and about 0.3 mg of menthol in the gas phase.

In addition, as a test for its storability, the loss of menthol during its storage in highly porous magnesium silicate hydrate was checked. This was done by leaving an approximately 2 mm high layer of magnesium silicate hydrate charged with 10 weight % at a temperature of about 20° to 22° C. for 2 months in a well ventilated free external atmosphere. Under these extreme conditions, the relative weight loss of menthol was about 17%, i.e. the magnesium silicate hydrate was still charged with 8.3 weight % of menthol, and this still represented a sufficient menthol quantity for sufficiently mentholating the smoke of a cigarette. In practice, the magnesium silicate hydrate charged with menthol is however situated in chambers in the cigarette filter closed on all sides, and are additionally packaged with the cigarettes provided with these latter in a relatively well sealed cigaretted packet, so that the menthol loss to the free external atmosphere is much smaller, and the storability is therefore much greater.

On the other hand, using magnesium silicate hydrate as a carrier material has the great advantage that when in the smoke stream it gives up the stored menthol in a very good and uniform manner under the influence of the smoke stream into the passing smoke, i.e. it has the ideal properties for retaining or storing aroma substances under the influence of air, and to give up these aroma substances to the tobacco smoke under the influence thereof.

2ND COMPARISON EXAMPLE

The following cigarettes were smoked under standard conditions:

(c) a commercially available menthol filter cigarette in which the tobacco is sprayed with menthol, and which comprises a normal acetate filter, and (d) a cigarette with the same tobacco (but not mentholated), but provided with a highly porous chamber filter containing granular magnesium silicate hydrate charged with menthol.

The following results were obtained:

| | c | d |
|---|---|---|
| Number of draws | 9 | 9 |
| Menthol in particulate phase | 0.45 mg | 0.45 mg |
| Menthol in gas phase | 0.28 mg | 0.27 mg |
| Total menthol quantity | 0.73 mg | 0.72 mg |

As can be seen from this table, the two methods (c) and (d) in practice give the same mentholating effect, however with the important difference that method (d) according to the invention for the production of menthol filter cigarettes is significantly simpler and cheaper.

Instead of filling the chamber of a chamber filter with magnesium silicate or magnesium silicate hydrate charged with an aroma substance, it is also possible to provide this latter in a mouth or end portion closed in an axial direction by means of two end walls having a negligible filter action, so that for example the tar and nicotine content of the passing smoke is practically unchanged, and thus corresponds to the smoke of a nonfilter cigarette, while on the other hand the passing smoke is additionally aromatised.

It is also possible to dispose the magnesium silicate or magnesium silicate hydrate charged with an aroma substance between the fibres of the filter material strands by means of an adhesive during the manufacture of a cigarette filter. In the case of a double filter, the carrier material charged with aroma substance would preferably be disposed in the filter plug adjoining the tobacco portion of the filter cigarette.

A magnesium silicate hydrate such as described for example in DE-PS No. 17 67 024 can be used for storing the aroma substance.

We claim:

1. A method for aromatising tobacco smoke drawn through a cigarette, mouthpiece characterised by using a porous magnesium silicate and/or magnesium silicate hydrate charged with aromatic substances selected from the group consisting of menthol and synthetic or natural tobacco extracts in the cigarette mouthpiece.

2. A method as claimed in claim 1, characterised by using a magnesium silicate or magnesium silicate hydrate with a magnesium content of at least 4 percent by weight, and preferably 8 to 25 percent by weight, with respect to the dry weight of magnesium silicate and/or magnesium silicate hydrate.

3. A method as claimed in claim 1, characterised by using a magnesium silicate or magnesium silicate hydrate charged with 5 to 14 percent by weight and preferably 8 to 10 percent by weight, with respect to the uncharged magnesium silicate or hydrate.

4. A method as claimed in claim 1, characterised in that the magnesium silicate and/or magnesium silicate hydrate charged with said aromatic substances is disposed in at least a part of a cigarette filter.

5. A method as claimed in claim 4, characterised in that the magnesium silicate and/or magnesium silicate hydrate charged with said aromatic substances is worked into at least a part of the filter material intended for a cigarette filter, for example a double filter.

6. A cigarette filter comprising a chamber containing at least granular magnesium silicate and/or magnesium silicate hydrate containing an aromatic substance selected from the group consisting of menthol and synthetic or natural tobacco extracts.

* * * * *